US007452255B2

(12) United States Patent
Hirade et al.

(10) Patent No.: US 7,452,255 B2
(45) Date of Patent: Nov. 18, 2008

(54) OUTBOARD MOTOR FOR SMALL WATERCRAFT

(75) Inventors: Katsuji Hirade, Shizuoka-ken (JP); Jun Nakata, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 81 days.

(21) Appl. No.: 11/257,656

(22) Filed: Oct. 25, 2005

(65) Prior Publication Data

US 2006/0089063 A1 Apr. 27, 2006

(30) Foreign Application Priority Data

Oct. 25, 2004 (JP) ..... 2004-309015

(51) Int. Cl.
*B63H 21/14* (2006.01)

(52) U.S. Cl. ..... 440/88 C

(58) Field of Classification Search ..... 440/80 C
See application file for complete search history.

(56) References Cited

U.S. PATENT DOCUMENTS 5,487,688 A * 1/1996 Sumigawa ..... 440/88 L
5,501,624 A 3/1996 Matsumoto et al.

FOREIGN PATENT DOCUMENTS

JP 08/034393 2/1996

* cited by examiner

*Primary Examiner*—Jesús D Sotelo
(74) *Attorney, Agent, or Firm*—Knobbe, Martens, Olson & Bear, LLP

(57) ABSTRACT

A casing of an outboard motor can be formed with an upper casing, a lower casing, and an extension casing interposed between the upper casing and the lower casing. Water guiding passages, which can be formed with jacket sections or the like, can extend along both inner side surfaces of the extension casing. The water guiding passages can communicate with a space. Water that leaks from a cooling water pump in the space is allowed to flow through the water guiding passages so as to be used as cooling water. A cooling water inlet of each jacket section can be made at a bottom end of a partition, while the cooling water outlet of each jacket section can be made at a top end of a partition. A bottom of each jacket section can be formed with a bottom closure member.

7 Claims, 4 Drawing Sheets

OUTBOARD MOTOR FOR SMALL WATERCRAFT

PRIORITY INFORMATION

This application is based on and claims priority to Japanese Patent Application No. 2004-309015, filed Oct. 25, 2004, the entire contents of which is hereby expressly incorporated by reference.

BACKGROUND OF THE INVENTIONS

1. Field of the Inventions

The present inventions relate to cooling systems, and more particularly, to cooling systems for outboard motors.

2. Description of the Related Art

Outboard motors typically include an exhaust passage for discharging exhaust gases from an engine to an external location. Additionally, outboard motors usually include a cooling water passage configured to introduce cooling water from the body of water in which the outboard motor is operating, to cool the engine.

In addition, another cooling water passage is usually defined in an upper portion of a casing that forms an outer wall of the outboard motor. For example, outboard motors usually include a cooling jacket that extends along respective inner side surfaces of an upper casing which houses a driveshaft that extends from the engine, and a lower casing, which has a propulsion shaft coupled with the driveshaft through a power transmission mechanism, to prevent the upper portion of the casing from being heated by the exhaust gases that have a high temperature and passing through the exhaust passage. A lower portion of the casing is usually placed below a surface of the water body when the associated watercraft runs. The outside water, such as seawater, thus can enter a lower portion of the exhaust passage. Accordingly, the lower portion of the casing can be cooled by seawater or the like.

However, a portion of each inner side surface of the casing positioned slightly above the water surface can be heated by the exhaust gases passing through the exhaust passage. As a result, a portion of each outer side surface of the casing corresponding to the inner portion heated by the exhaust gases can have a high temperature. Under these circumstances, if the seawater adheres to the portions of the outer side surfaces, a calcium component of the seawater can be separated to whiten the outer side surfaces of the casing. Japanese Patent Publication Number JP-A Hei08-034393 discloses a cooling mechanism at a portion of the casing that can be positioned above the water surface.

This outboard motor has water guiding passages allowing a portion of the cooling water that has already cooled the engine to fall along respective portions of the outer side surfaces of the casing that are exposed above the water line when the watercraft is moving. Because the portion of the cooling water is discharged to the respective portions of the outer side surfaces from the water guiding passages, the whitening of the outer surfaces can be reduced.

SUMMARY OF THE INVENTIONS

An aspect of at least one of the embodiments disclosed herein includes the realization that where cooling water is discharged to cascade over the outer surfaces of a portion of an outboard motor, the cooling effect thereby achieved can still fail to provide a sufficient cooling effect. For example, because such cooling water is only applied to the outer surfaces, the inner surfaces heeded by the exhaust gases are not sufficiently cooled. Further, the heat transfer from the outer surfaces to the cooling water can be intermittent and unstable because the casing is only cooled while the cooling water falls along the outer side surfaces.

Thus, in accordance with at least one of the embodiments disclosed herein, an outboard motor can include a casing housing an engine, a driveshaft extending downwardly from the engine, and a propulsion device coupled with a bottom end of the driveshaft. An exhaust passage can extend from the engine to an external location through the propulsion device and through the casing. The outboard motor can also include a cooling water passage for cooling the engine by cooling water introduced therein from outside. The casing can include an outer wall and an inner wall unitarily coupled with each other so as to define a double wall structure on both a starboard and port side of the exhaust passage. A water guiding passage can extend between each set of the outer wall and the inner wall to cool the casing.

DETAILED DESCRIPTION OF THE PREFERRED EMBODIMENT

The embodiments disclosed herein are described in the context of an outboard motor because these embodiments have particular utility in this context. However, the embodiments and inventions herein can also be applied to marine devices and vehicles including, but not limited to, personal watercraft, small jet boats, as well as other vehicles.

Figure 1:
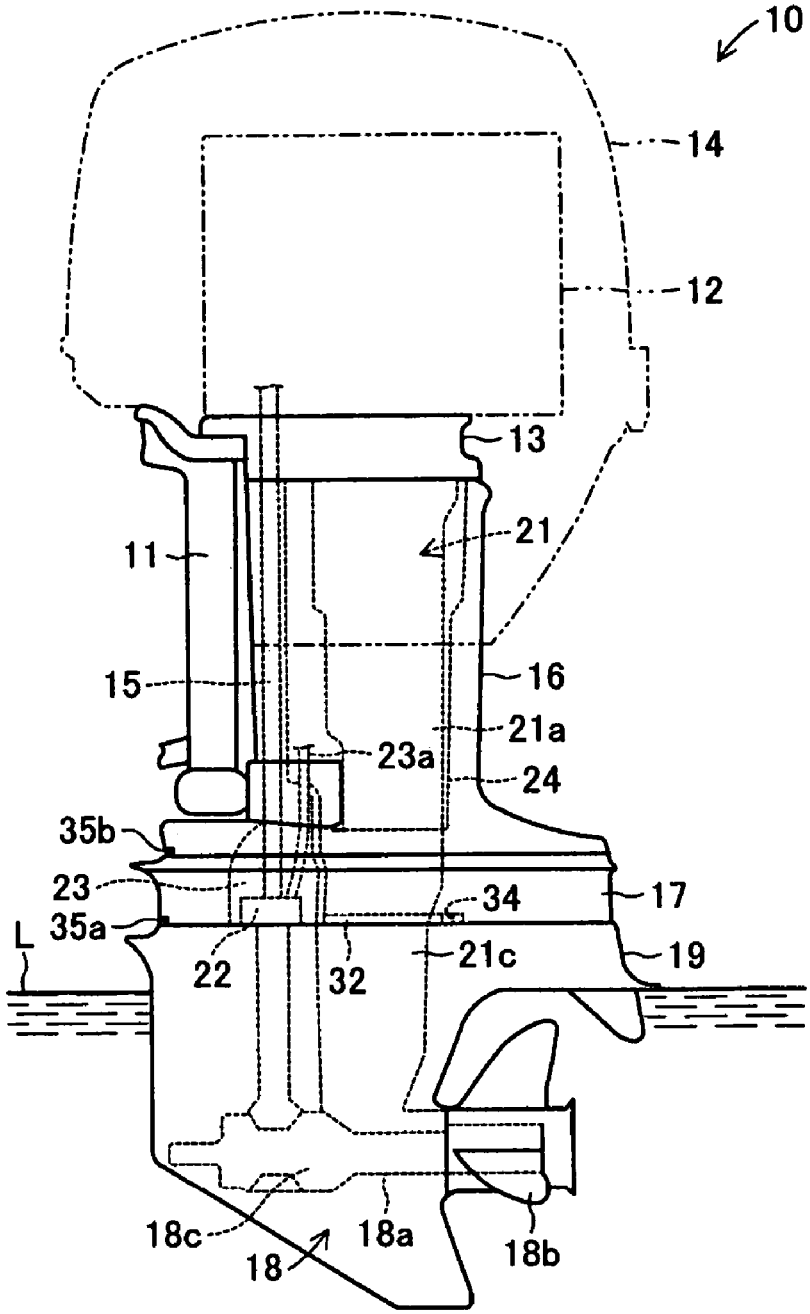
FIG. 1 is a side elevational view of an outboard motor according to one embodiment, with certain internal components illustrated in phantom.

With reference to FIG. 1, the outboard motor 10 can be mounted on a transom board of a hull of an associated watercraft (not shown) by a bracket assembly including a swivel bracket 11 and a clamping bracket (not shown), so as to be steerable and tiltable. The outboard motor 10 can include an engine 12 and an exhaust guide 13 on which the engine 12 is supported.

A cowling 14 can enclose the engine 12 and the exhaust guide 13. An upper casing 16 having a driveshaft 15, can be coupled with a bottom of the cowling 14. A lower casing 19 having a propulsion device 18 can also be coupled with a bottom of the upper casing 16 via an extension casing 17.

The driveshaft 15 can extend generally vertically in the interior of the outboard motor 10 through the exhaust guide 13, the upper casing 16 and the extension casing 17. A top end of the driveshaft 15 can be coupled with a bottom end of a crankshaft (not shown) of the engine 12. The driveshaft 15 can extend into the lower casing 19, and a bottom end of the driveshaft 15 can be coupled with the propulsion device 18.

The propulsion device 18 can include a propulsion shaft **18*a* extending generally horizontally and a propeller 18*b*** affixed to a rear end of the propulsion shaft 18*a*. The propulsion shaft 18*a* can be coupled with the bottom end of the driveshaft 15 via bevel gears 18*c* attached to a front end of the propulsion shaft 18*a*. Thus, when the engine 12 operates, its driving force is transmitted to the propeller 18*b* through the crankshaft, the driveshaft 15, the bevel gears 18*c* and the propulsion shaft 18*a*. The propeller 18*b* rotates to generate the thrust force, accordingly.

The outboard motor 10 can include an exhaust passage 21 in the center thereof and below the engine 12. However, other configurations can also be used. The exhaust passage 21 can extend through the exhaust guide 13, the upper casing 16, the extension casing 17 and the lower casing 19 and communicate with an external location at the rear end of the propulsion shaft 18*a* of the propulsion device 18. That is, the exhaust passage 21 can include an exhaust passage (not shown) of the exhaust guide 13, an exhaust passage 21*a* of the upper casing 16, an exhaust passage 21*b* (see FIGS. 2 and 4) of the extension casing 17, and an exhaust passage 21*c* of the lower casing 19. A lower portion of the exhaust passage 21*c* can extend rearwardly along the propulsion shaft 18*a* so that the exhaust passage 21*c* communicates with the external location through the rear end of the propeller 18*b*. The exhaust gases coming from the engine 12 thus pass through the exhaust passage 21 and are discharged to the body of water.

A cooling water pump 22 can be affixed to a portion of the driveshaft 15 positioned in the extension casing 17 at a circumferential surface thereof. The cooling water pump 22 can have a pressurizing chamber therein.

A cooling water path 23*a* extends toward the engine 12 from an upper end of the pressurizing chamber. The cooling water pump 22 thus rotates together with the driveshaft 15 to draw in seawater or the like entering the lower casing 19 and to pump it to the cooling water path 23*a* and further to the engine 12 so that the cooling water cools various portions of the engine 12.

The pressurizing chamber of the cooling water pump 22 and the cooling water path 23*a* together form a cooling water passage. A space 23 can be defined around the cooling water pump 22. Leaking water that leaks from the cooling water pump 22 can accumulate in the space 23. During operation, the lower portion of the outboard motor 10 is submerged below the water surface L of FIG. 1.

The upper casing 16 can include a water wall forming section 24 around the exhaust passage 21. The water wall forming section 24 can be filled with a portion of the cooling water and can allow the portion of the cooling water to move out therefrom gradually.

The cooling water path 23*a* can be bifurcated upstream of various cooling water paths (not shown) of the engine 12 to have a branch path to introduce the portion of the cooling water into the water wall forming section 24. The portion of the cooling water introduced into the water wall forming section 24 can absorb the heat of the exhaust gases that pass through the exhaust passage 21*a* of the upper casing 16. The upper casing 16 thus can be prevented from being heated to a high temperature. The cooling water passing through the water wall forming section 24 can be drained through a drain port (not shown) of the lower casing 19.

With reference to FIGS. 2-5, the extension casing 17 can have a frame body made of aluminum produced by die-casting. However, other materials and manufacturing processes can also be used.

Figure 2:
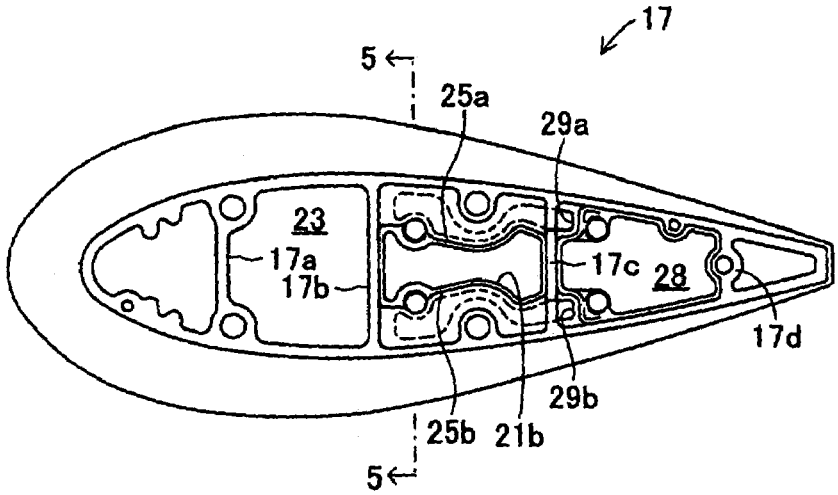
FIG. 2 is a top plan view of an extension casing of the outboard motor of FIG. 1.
Figure 4:
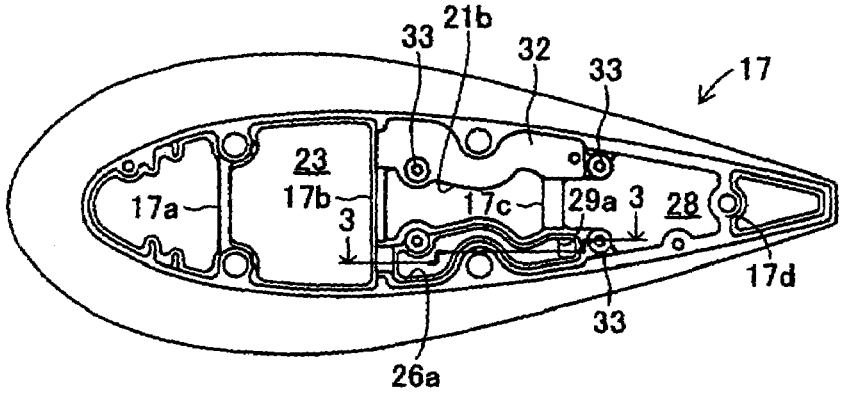
FIG. 4 is a bottom plan view of the extension casing illustrated in FIG. 3.
Figure 5:
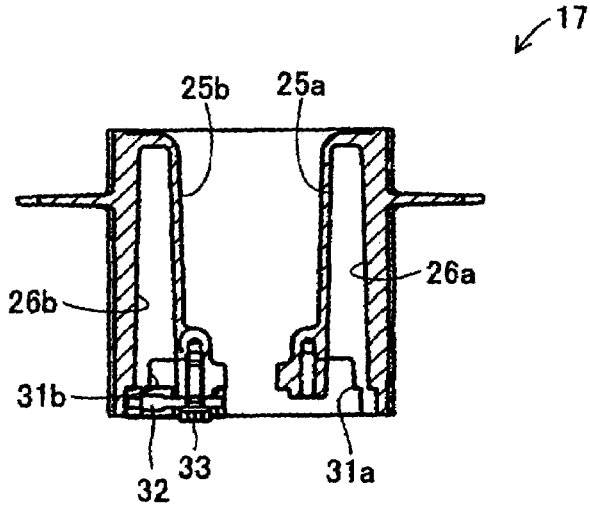
FIG. 5 is a cross sectional view taken along the line 5-5 of FIG. 2.

In the plan views shown in FIGS. 2 and 4, the extension casing 17 generally has an elliptical shape such that a front portion is wider than a rear portion. The interior of the extension casing 17 can be divided into four spaces by partitions 17*a*, 17*b*, 17*c*, 17*d* spaced apart at certain intervals in the fore to aft direction. In addition, the space between the partitions 17*b*, 17*c* can be further divided into three sub-spaces by partitions 25*a*, 25*b*. The partitions 25*a*, 25*b* can be spaced apart bilaterally symmetrically from each other, however, other configurations can also be used.

The sub-space surrounded by the partitions 17*b*, 17*c*, 25*a*, 25*b* can be used as the exhaust passage 21*b*. The respective sub-spaces located on both sides of the exhaust passage 21*b* are jacket sections 26*a*, 26*b*. Each jacket section 26*a*, 26*b* has a closed top and a bottom thereof opens downward.

Figure 3:
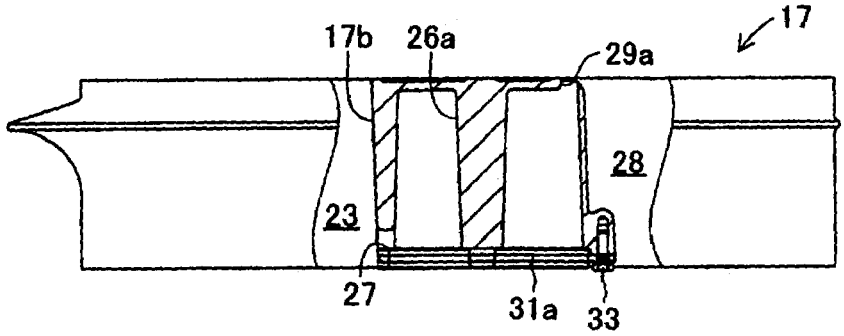
FIG. 3 is partial sectional and side elevational view of the extension casing, the sectional portion taken a long line 3-3 of FIG. 4.

A space 23 can be formed between the partitions 17*a*, 17*b* to house the cooling water pump 22 therein. As shown in FIG. 3, the space 23 and the respective internal cavities of the jacket sections 26*a*, 26*b* communicate with each other through respective cooling water inlets 27 positioned at bottom ends of the partition 17*b* (the cooling water inlet of the jacket section 26*b* is not shown).

The space between the partitions 17*c*, 17*d* can be a water discharging space 28. The respective internal cavities of the jacket sections 26*a*, 26*b* and the water discharging space 28 can communicate with each other through respective cooling water outlets 29 positioned at ends of the partition 17*c* in the closed top. Additionally, a rear end of each jacket section 26*a*, 26*b* can project rearwardly from the partition 17*c*. The respective cooling water outlets 29*a*, 29*b* thus can be positioned rearwardly of the partition 17*c*.

Figure 6:
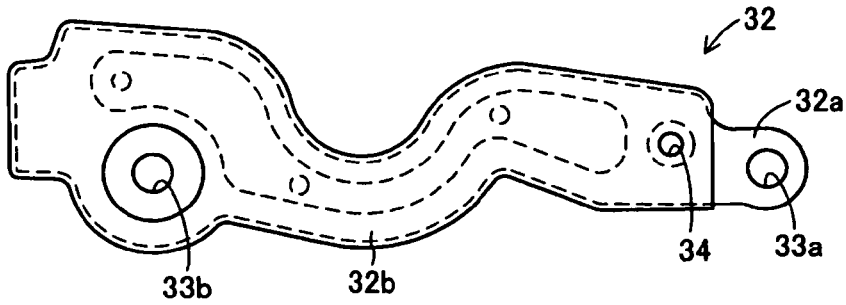
FIG. 6 is a top plan view of a bottom closure member.
Figure 7:
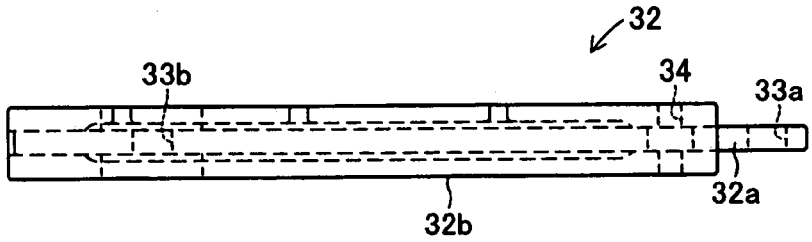
FIG. 7 is a side elevational view of the bottom closure member illustrated in FIG. 6.

A bottom closure member 32 can be fixed to a peripheral edge of each jacket section 26*a*, 26*b* around the opening 31*a*, 31*b* thereof by screws 33 (the bottom closure member 32 for the opening 31*a* is not shown). As shown in FIGS. 6 and 7, each bottom closure member 32 can be formed with a core 32*a* made of an aluminum plate and an elastic cover 32*b* made of a rubber material and covering both inside and outside surfaces of the metal core 32*a*. However, other materials can also be used.

One end of each core 32*a* (i.e., the end which can be placed in the most rear position when the member 32 is fixed, and the right end in FIGS. 6 and 7) and a side portion of the other end have screw holes 33*a*, 33*b*, respectively. The end of the core 32*a* having the screw hole 33*a* can be left exposed, for example, such that it is not covered by the elastic cover 32*b*. Respective peripheral areas around the screw hole 33*b* on both the inside and outside surfaces also can be left exposed, such that they are not covered by the elastic cover 32*b*. Thus, each bottom closure member 32 can be easily fixed by the screws 33.

A small hole for water drain 34 can extend generally vertically through a portion of each closure member 32 covered by the elastic cover 32*b* and most adjacent to the one end of the core 32*a*. The small hole 34 of each closure member 32 can be positioned to correspond to the respective cooling water outlet 29*a*, 29*b* when each closure member 32 is affixed to the peripheral edge around the opening 31*a*, 31*b*.

As such, a portion of the cooling water in the space 23 (i.e., the remainder portion of the cooling water that is not pressurized to the cooling water path 23*a*) enters the jacket sections 26*a*, 26*b* through the respective cooling water inlets 27 to fill the internal cavities of the jacket sections 26*a*, 26*b* and then overflows to the water discharging space 28 through the cooling water outlets 29*a*, 29*b*. Meanwhile, a further portion of the cooling water that does not overflow can be drained through the respective small holes 34. Both the water discharging space 28 and the small holes 34 communicate with the interior of the lower casing 19. Consequently, a portion of the cooling water is discharged to the external location through a passage defined in the rear of the exhaust passage 21*c* within the lower casing 19 under an isolated condition from the exhaust gases.

The cooling water inlets 27, the jacket sections 26*a*, 26*b*, the cooling water outlets 29*a*, 29*b*, the water discharging space 28, the small holes 34 and so forth together can form water guiding passages. The outboard motor 10 can also have small apertures 35*a*, 35*b* extending through a front surface thereof adjacent to the cooling water pump 22 to drain a portion of the leaking water. Thus, the air and the leaking water coming from the cooling water pump 22 also can be discharged through the small apertures 35*a*, 35*b*.

As thus constructed, when the engine 12 is running, the driving force of the engine 12 is transmitted to the propulsion device 18 through the crankshaft and the driveshaft 15. The propeller 18*b* rotates to generate a thrust for propelling the watercraft. Under these conditions, the cooling water pump 22 operates together with the rotation of the driveshaft 15 to draw seawater into the lower casing 19. The water is pressurized in the pressurizing chamber of the cooling water pump 22 and thereby pumped into the cooling water path 23*a* and further into the engine 12.

The cooling water bifurcates upstream of the various cooling paths of the engine 12. A portion of the cooling water is guided to the water wall forming section 24 to accumulate therein. The cooling water accumulated in the water wall forming section 24 prevents an outer circumferential portion of the upper casing 16 from being heated by the exhaust gases passing through the exhaust passage 21*a* after being discharged from the engine 12. The cooling water in the water wall forming section 24 can be finally discharged to the external location through the water discharging space 28 formed in the lower casing 19.

The remainder portion of the cooling water that is not transferred to the cooling water path 23*a* can accumulate in the space 23 as the leaking water. A further portion of this cooling water can flow into the internal cavities of the jacket sections 26*a*, 26*b*, while the rest of the cooling water can be drained outside through the small apertures 35*a*, 35*b*. Under these conditions, the air bubbles discharged from the cooling water pump 22 can be discharged to the internal cavities of the jacket sections 26*a*, 26*b* or outside through the cooling water inlets 27 or the small apertures 35*a*, 35*b*, respectively. The cooling water flowing into the internal cavities of the jacket sections 26*a*, 26*b* accumulate therein, and overflows to the water discharging space 28 through the cooling water outlets 29*a*, 29*b* when the cavities of the jacket sections 26*a*, 26*b* are filled with the cooling water.

Meanwhile, the cooling water in the jacket sections 26*a*, 26*b* also is drained to the interior of the lower casing 19 little by little through the small holes 34 of the bottom closure members 32. The cooling water flowing out through the water discharging space 28 and the small holes 34 is discharged to the external location through the passage defined in the rear of the exhaust passage 21*c* within the lower casing 19. While flowing out, the cooling water in the internal cavities of the jacket sections 26*a*, 26*b* inhibits the exhaust gases passing through the exhaust passage 21*b* from heating the extension casing 17.

As thus described, according to the outboard motor 10 of this embodiment, the extension casing 17 has the jacket sections 26*a*, 26*b* on both sides along the inner surface thereof, and the cooling water slowly passes through the respective internal cavities of the jacket sections 26*a*, 26*b*. The cooling water thus can effectively reduce the heating of the outer circumferential portion of the extension casing 17 by the exhaust gases. In addition, because the internal cavities of the jacket sections 26*a*, 26*b* are fully filled with the cooling water, the transmission of the heat to the outer circumferential portion of the extension casing 17 from the exhaust gases can also be reduced. The whitening of the outer surface of the extension casing 17 thus can be attenuated or eliminated.

In some embodiments, each jacket section 26*a*, 26*b* only needs to have the cooling water inlet 27 positioned at the bottom end of the partition 17*b* so as to communicate with the space 23. The structure can be simple, and can be easily produced, accordingly. In addition, because the leaking water that leaks from the cooling water pump 22 with air bubbles entrained therein can be used as the cooling water that flows through the jacket sections 26*a*, 26*b*, the cooling water that needs to be primarily transferred to the engine 12 is not reduced, and no additional load is exerted on the primary cooling water pump.

Each jacket section 26*a*, 26*b* can open downwardly, and the bottom closure member 32 can be detachably fixed to the peripheral edge around the opening 31*a*, 31*b*. The extension casing 17 thus can be easily produced by die-casting. However, other manufacturing techniques can also be used. Also, each bottom closure member 32 can be formed with the core 32*a* made of aluminum and the elastic member 32*b* made of rubber. Thus, the bottom portion of each jacket section 26*a*, 26*b* can be solid and water-tight. However, other materials can also be used.

The inventions disclosed herein are not limited to the embodiments described above and can have wide varieties of other embodiments or alternatives. For example, the present inventions can apply to other outboard motors that have no extension casing, although the outboard motor described above has the water guiding passages such as the jacket sections 26*a*, 26*b* or the like in its extension casing. In such embodiments, the water guiding passages can be positioned at or adjacent to a border between the upper casing and the lower casing. Thereby, such an outboard motor having no extension casing can achieve the same advantages as the other embodiments described above.

In some embodiments, each jacket section 26*a*, 26*b* can have closed tops and open downwardly. However, each jacket section 26*a*, 26*b* can have a closed bottom and open upwardly, or can have the closed top and the closed bottom both of which are unitarily formed with the body of the casing. In such embodiments, the small hole for water drain can be made at the bottom or can be omitted. In addition, the other portions, members or components that form the outboard motor of the present inventions can be properly changed, varied or altered within the scope of art of the present inventions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An outboard motor including a casing housing an engine, a driveshaft extending downwardly from the engine, a propulsion device coupled with a bottom end of the driveshaft, an exhaust passage extending from the engine to an external location through the propulsion device and extending through the casing housing, and a cooling water passage for cooling the engine by cooling water introduced thereinto from outside, wherein the casing housing includes an outer wall and an inner wall unitarily coupled with each other so as to define a double wall structure on both a starboard and port side of the exhaust passage, and wherein a water guiding passage extends between each set of the outer wall and the inner wall to cool the casing housing, wherein each water guiding passage includes a jacket section defining an internal cavity which is configured to accumulate a portion of the cooling water, each jacket section having a cooling water inlet positioned at a lower portion of a front end or a rear end of the jacket section, and each jacket section having a cooling water outlet positioned at an upper portion of the remainder of the front end and the rear end of the jacket section.

2. An outboard motor including a casing housing an engine, a driveshaft extending downwardly from the engine, a propulsion device coupled with a bottom end of the driveshaft, an exhaust passage extending from the engine to an external location through the propulsion device and extending through the casing housing, and a cooling water passage for cooling the engine by cooling water introduced thereinto from outside, wherein the casing housing includes an outer wall and an inner wall unitarily coupled with each other so as to define a double wall structure on both a starboard and port side of the exhaust passage, and wherein a water guiding passage extends between each set of the outer wall and the inner wall to cool the casing, wherein the casing housing comprises an upper casing housing the driveshaft, a lower casing housing the propulsion device, and an extension casing interposed between the upper casing and the lower casing, and wherein the water guiding passage extends between each set of the outer wall and the inner wall of the extension casing, wherein each water guiding passage includes a jacket section defining an internal cavity which is configured to accumulate a portion of the cooling water, each jacket section having a cooling water inlet positioned at a lower portion of a front end or a rear end of the jacket section, and each jacket section having a cooling water outlet positioned at an upper portion of the remainder of the front end and the rear end of the jacket section.

3. An outboard motor including a casing housing an engine, a driveshaft extending downwardly from the engine, a propulsion device coupled with a bottom end of the driveshaft, an exhaust passage extending from the engine to an external location through the propulsion device and extending through the casing housing, and a cooling water passage for cooling the engine by cooling water introduced thereinto from outside, wherein the casing housing includes an outer wall and an inner wall unitarily coupled with each other so as to define a double wall structure on both a starboard and port side of the exhaust passage, and wherein a water guiding passage extends between each set of the outer wall and the inner wall to cool the casing housing, wherein the cooling water passage bifurcates to form the water guiding passages, and wherein each water guiding passage includes a jacket section defining an internal cavity which is configured to accumulate a portion of the cooling water, each jacket section having a cooling water inlet positioned at a lower portion of a front end or a rear end of the jacket section, and each jacket section having a cooling water outlet positioned at an upper portion of the remainder of the front end and the rear end of the jacket section.

4. An outboard motor including a casing housing an engine, a driveshaft extending downwardly from the engine, a propulsion device coupled with a bottom end of the driveshaft, an exhaust passage extending from the engine to an external location through the propulsion device and extending through the casing housing, and a cooling water passage for cooling the engine by cooling water introduced thereinto from outside, wherein the casing housing includes an outer wall and an inner wall unitarily coupled with each other so as to define a double wall structure on both a starboard and port side of the exhaust passage, and wherein a water guiding passage extends between each set of the outer wall and the inner wall to cool the casing housing, wherein the cooling water passage includes a pump, and wherein said cooling water comprises water leaking from the pump through an air vent thereof, and wherein each water guiding passage includes a jacket section defining an internal cavity which is configured to accumulate a portion of the cooling water, each jacket section having a cooling water inlet positioned at a lower portion of a front end or a rear end of the jacket section, and each jacket section having a cooling water outlet positioned at an upper portion of the remainder of the front end and the rear end of the jacket section.

5. The outboard motor according to claim 4, wherein a bottom portion of each jacket section has a small hole for water drain.

6. The outboard motor according to claim 5, wherein the bottom portion of each jacket section is a closure member detachably affixed to the remainder of the jacket section.

7. The outboard motor according to claim 4, wherein the bottom portion of each jacket section is a closure member detachably affixed to the remainder of the jacket section.

* * * * *

UNITED STATES PATENT AND TRADEMARK OFFICE

CERTIFICATE OF CORRECTION

PATENT NO. : 7,452,255 B2
APPLICATION NO. : 11/257656
DATED : November 18, 2008
INVENTOR(S) : Katsuji Hirade et al.

It is certified that error appears in the above-identified patent and that said Letters Patent is hereby corrected as shown below:

At column 7, line 37, In Claim 2, change "casing," to --casing housing,--.

Signed and Sealed this

Sixth Day of April, 2010

David J. Kappos

David J. Kappos
*Director of the United States Patent and Trademark Office*